US008308499B2

(12) United States Patent
Yeh

(10) Patent No.: US 8,308,499 B2
(45) Date of Patent: Nov. 13, 2012

(54) DUPLEX PROFILE CONNECTOR ASSEMBLY HAVING RETENTION MEANS FOR ASSEMBLING UPPER AND LOWER CONNECTORS THEREOF TOGETHER

(75) Inventor: Cheng-Chi Yeh, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/052,116

(22) Filed: Mar. 21, 2011

(65) Prior Publication Data

US 2012/0045941 A1 Feb. 23, 2012

(30) Foreign Application Priority Data

Aug. 20, 2010 (TW) ..... 99216021 U

(51) Int. Cl.
*H01R 13/62* (2006.01)

(52) U.S. Cl. ..... 439/326

(58) Field of Classification Search ..... 439/326, 439/328, 541.5, 626
See application file for complete search history.

(56) References Cited

U.S. PATENT DOCUMENTS 5,030,115 A * 7/1991 Regnier et al. ..... 439/108
5,697,802 A * 12/1997 Kawabe ..... 439/326
5,755,585 A 5/1998 Cheng et al.
6,077,098 A * 6/2000 Yu et al. ..... 439/326
6,126,472 A * 10/2000 Choy ..... 439/328
6,210,194 B1 4/2001 Choy
6,319,035 B1 * 11/2001 Choy ..... 439/326
6,341,971 B1 * 1/2002 Choy et al. ..... 439/326
6,554,641 B1 * 4/2003 Wu ..... 439/541.5
6,612,867 B1 * 9/2003 Wu ..... 439/541.5
6,821,144 B2 * 11/2004 Choy ..... 439/541.5
7,445,497 B2 * 11/2008 Zhang ..... 439/541.5
7,931,495 B2 * 4/2011 Zhu ..... 439/541.5

* cited by examiner

*Primary Examiner* — Alexander Gilman

(74) *Attorney, Agent, or Firm* — Wei Te Chung; Ming Chieh Chang

(57) ABSTRACT

A double-deck connector assembly comprises an unitary insulating housing defining upper and lower connection ports slightly offset from each other in a front-to-back direction thereof for respectively receiving upper and lower modules therein. The upper connection port has a pair of holding arms extending from two opposite ends thereof. The lower connection port has a pair of lower latching arms extending from two opposite ends thereof. The lower latching arms extend in a same direction with the holding arms and each has a sliding slot at an outside thereof. The sliding slots can match with the holding arms to assemble the upper and lower connection ports together.

17 Claims, 5 Drawing Sheets

DUPLEX PROFILE CONNECTOR ASSEMBLY HAVING RETENTION MEANS FOR ASSEMBLING UPPER AND LOWER CONNECTORS THEREOF TOGETHER

BACKGROUND OF THE INVENTION

1. Field of the Invention

The present invention relates to a double-deck connector assembly, and particularly to a double-deck connector assembly configured by an upper connector and a lower connector in which interlocking mechanism is arranged therebetween such that the upper and lower connectors can be readily and reliably interlocked together.

2. Description of Related Art

A double deck connector assembly disclosed in U.S. Pat. No. 6,821,144 and issued to Choy on Nov. 23, 2004 includes stacked upper and lower connectors each having an elongate insulating housing and a plurality of terminal groups received in the insulating housing. Each insulating housing includes a main body defining a central slot for receiving a module therein and two rows of passageways on two sides of the central slot for receiving the terminals. The insulating housing of the upper connector also has a standoff portion extending downwardly from two sides of the main body and a receiving space surrounded by the main body and the standoff portion for receiving the lower connector therein. The double deck connector assembly establishes electrical connection between the upper and lower connectors and the printed circuit board through the terminal groups are soldered to the printed circuit board by the soldering balls.

When reflowing the soldering balls to solder the terminal groups to the printed circuit board, the upper and lower connectors are moved toward the printed circuit board by its own weight and have different subsidence because the upper and lower connectors are not assembled together. The modules respectively received in the central slots of the upper and lower connectors interfere with each other and can not be assembled to the double deck connector assembly when the subsidence of the upper connector is larger than that of the lower connector, so that the double deck connector assembly can not achieve electrical connection between the modules and the printed circuit board. And the upper and lower connectors need to be prepositioned before soldered to the printed circuit board, so as to increase difficulty of the operation.

Hence, it is desirable to provide an improved double deck connector assembly to overcome the aforementioned disadvantages.

SUMMARY OF THE INVENTION

Accordingly, an object of the present invention is to provide a double deck connector assembly having retention means for assembling upper and lower connectors together before soldered to a printed circuit board, so as to make assembling process and structure of the connector assembly simple.

According to one aspect of the present invention, a double deck connector assembly comprises upper and lower connectors each having an insulating housing and a plurality of terminals received in the corresponding insulating housing. Each housing has a pair of latch devices extending in a same direction from two opposite sides thereof. The latch devices of the lower connector define a pair of sliding slots. The latch devices of the upper connector define a pair of holding arms matching with the sliding slots to assembly the upper and lower connectors together.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

FIGS. 1-5 illustrate a double deck connector assembly 100 in accordance to a preferred embodiment of the present invention comprises upper and lower connectors 1, 2 assembled together for electrically connecting upper and lower modules to a same mother board at the same time. The upper and lower connectors 1, 2 are vertically aligned with a minimum offset in a front-to-back direction.

Figure 1:
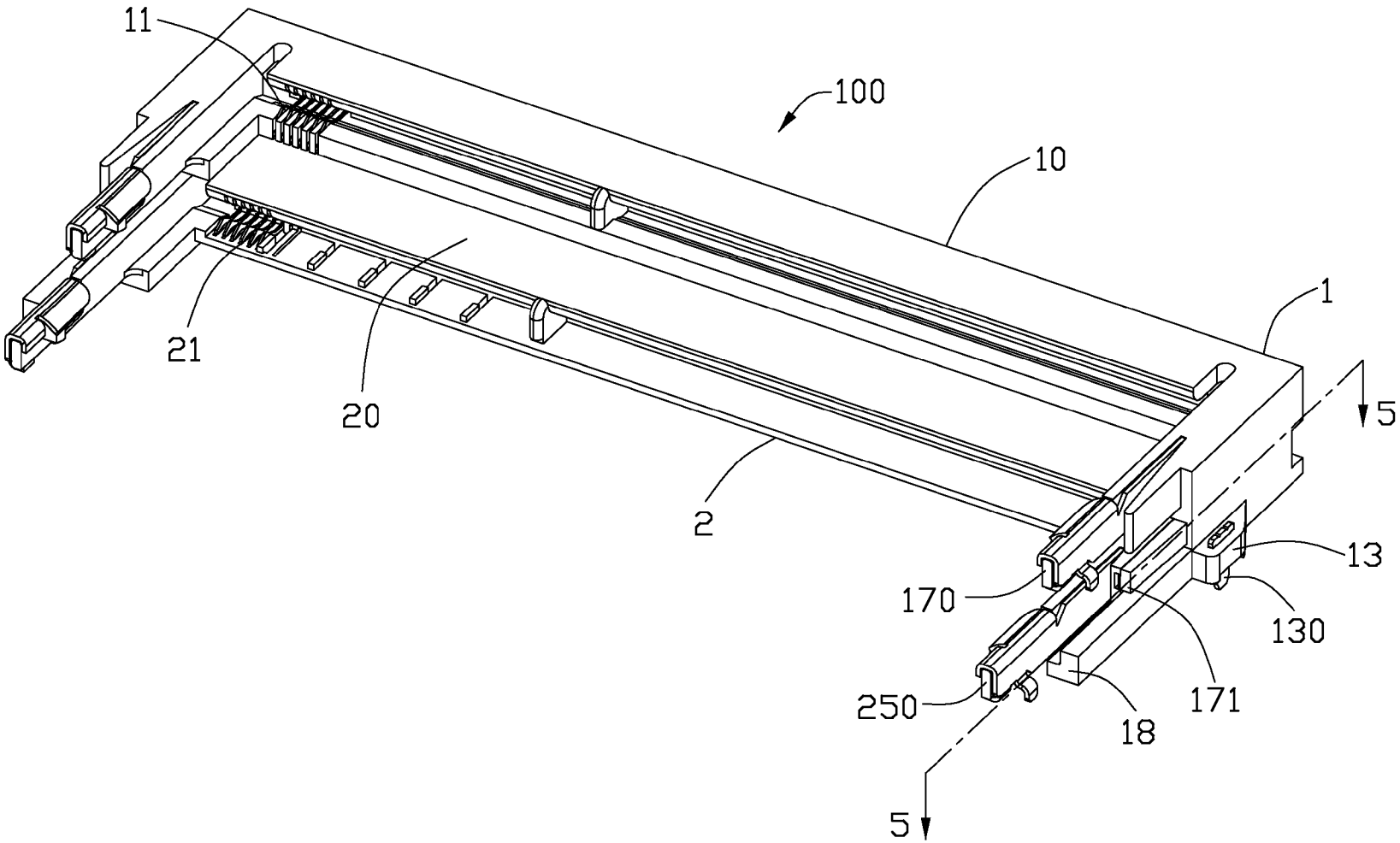
FIG. 1 is a perspective view of a present preferred embodiment of a double deck connector assembly comprising an upper connector and a lower connector, according to the invention.
Figure 2:
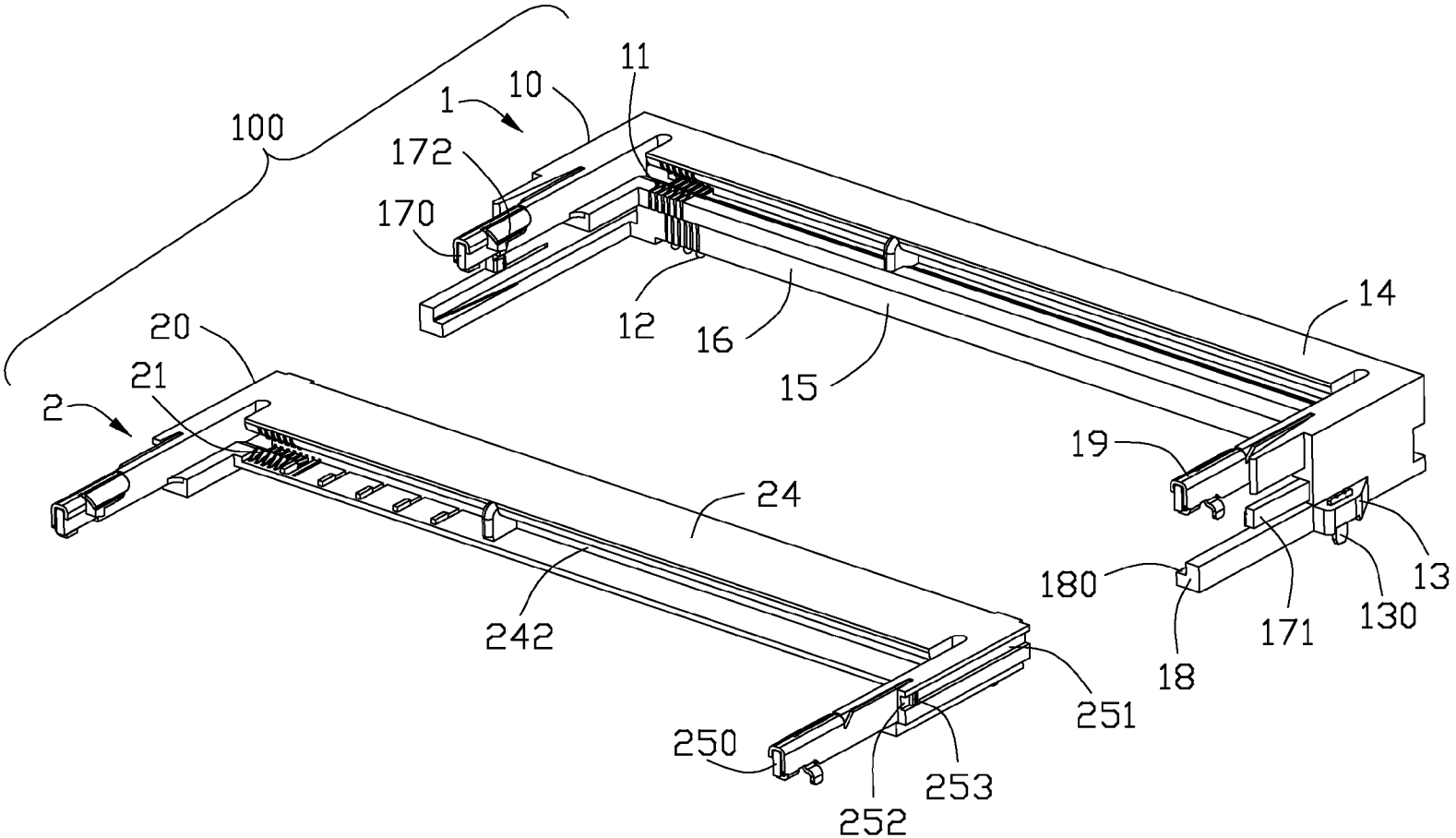
FIG. 2 is an exploded, perspective view of the double deck connector assembly of FIG. 1, showing the upper and lower connectors being separated from each other.
Figure 3:
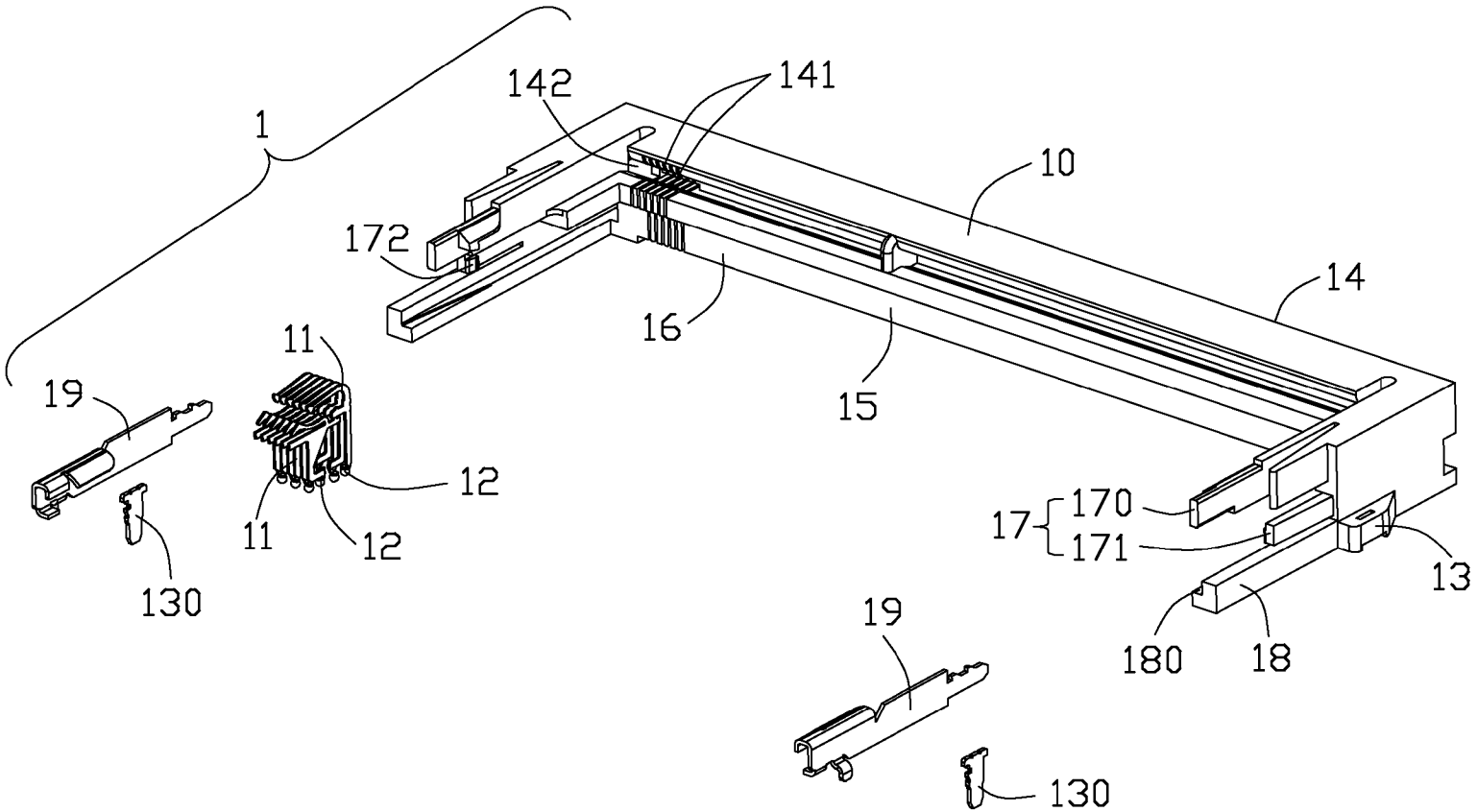
FIG. 3 is an exploded, perspective view of the upper connector shown in FIG. 2.

Referring to FIGS. 1 to 3, the upper connector 1 comprises an elongate upper insulating housing 10, a plurality of upper terminals 11 received in the upper housing 10 and a plurality of fusible members 12 each disposed at a bottom of the corresponding upper terminal 11. The upper insulating housing 10 includes an upper main body 14 defining an upper central slot 142 for receiving an upper module (not shown) therein and a standoff portion 15 extending downwardly from the upper main body 14. A plurality of upper passageways 141 are defined in the upper main body 14 on opposite sides of the upper central slot 142 for receiving the corresponding upper terminals 11 whereby the upper terminals 11 can electrically and mechanically engage with corresponding circuit pads formed on the upper module (not shown). The standoff portion 15 has a projection 13 projecting outside therefrom. The projection 13 can match with the metal ear 130 to position the double deck connector assembly 100 on a printed circuit board (not shown).

The upper insulating housing 10 also has a pair of upper latch devices 17 integrally formed at two opposite ends of the upper main body 14 and a pair of guiding arms 18 integrally formed at two opposite sides of the standoff portion 15. A receiving space 16 for receiving the lower connector 2 is surrounded by the guiding arms 18, the upper main body 14 and the standoff portion 15. The upper latch devices 17 and the guiding arms 18 are located at a same side of the upper main body 14. The upper latch devices 17 each includes an upper latching arm 170 extending from a side of the upper main body 14 in a horizontal direction and a holding arm 171 extending from a top portion of the standoff portion 15 in a horizontal direction. The holding arm 171 located under the upper latching arm 170 defines a hook 172 projecting inwardly from an end thereof.

Each guiding arm 18 located under the holding arm 171 extends from a bottom portion of the standoff portion 15 in a horizontal direction and defines a guiding groove 180 located below the upper latching arm 170. The holding arm 171 is disposed between the upper latching arm 170 and the guiding arm 18. The guiding groove 180 is used to guide the lower connector 2 into the upper connector 1. The upper latching arm 170 can retain the corresponding upper module (not shown) in the upper central slot 142 of the upper connector 1. A metal supporting arm 19 is disposed beside each upper latching arm 170 and directly fastened to the upper housing 10 for provision of auxiliary strength of the upper latching arm 170 during deflection of the upper latching arm 170.

Figure 4:
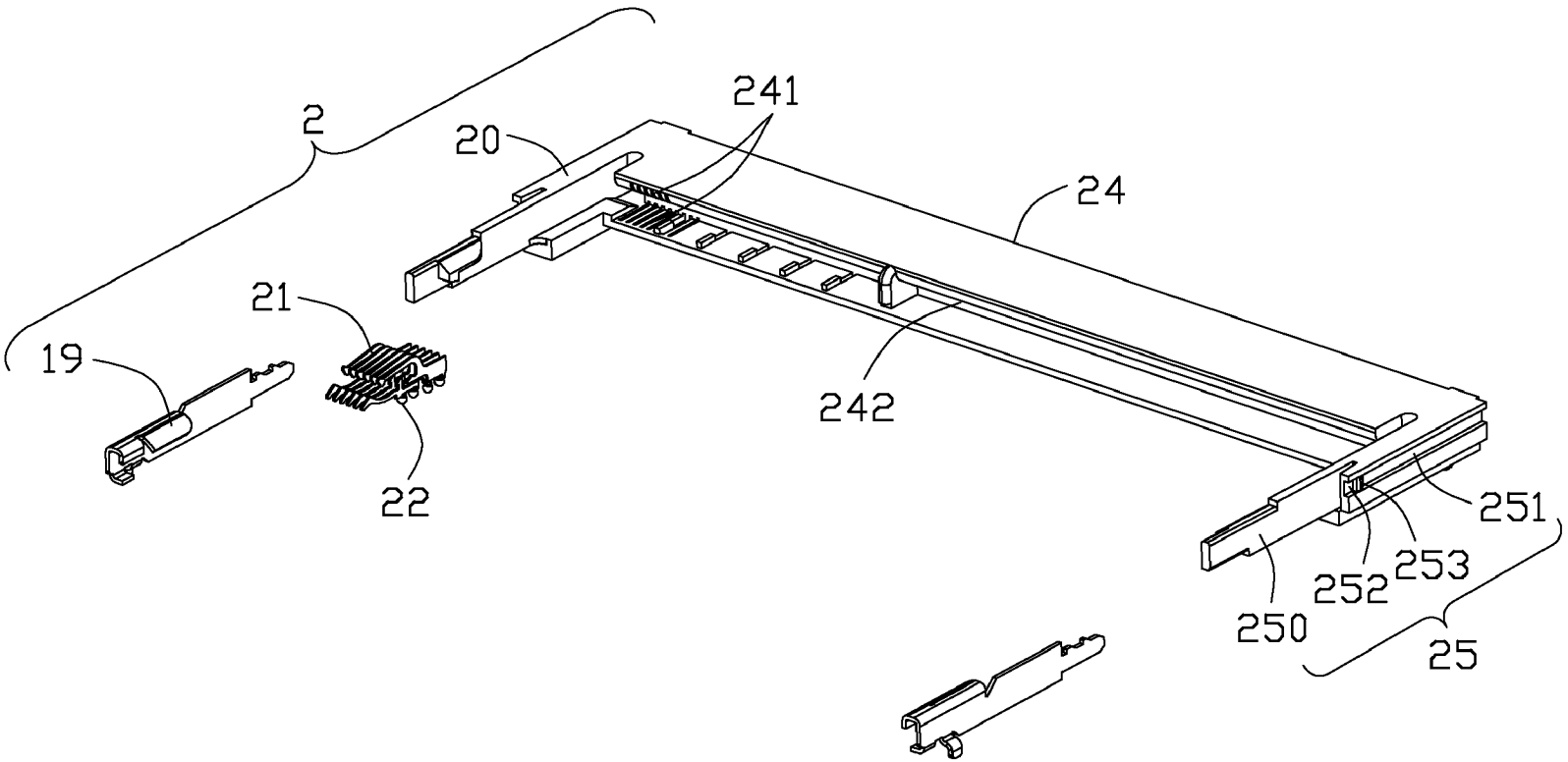
FIG. 4 is an exploded, perspective view of the upper connector shown in FIG. 2.
Figure 5:
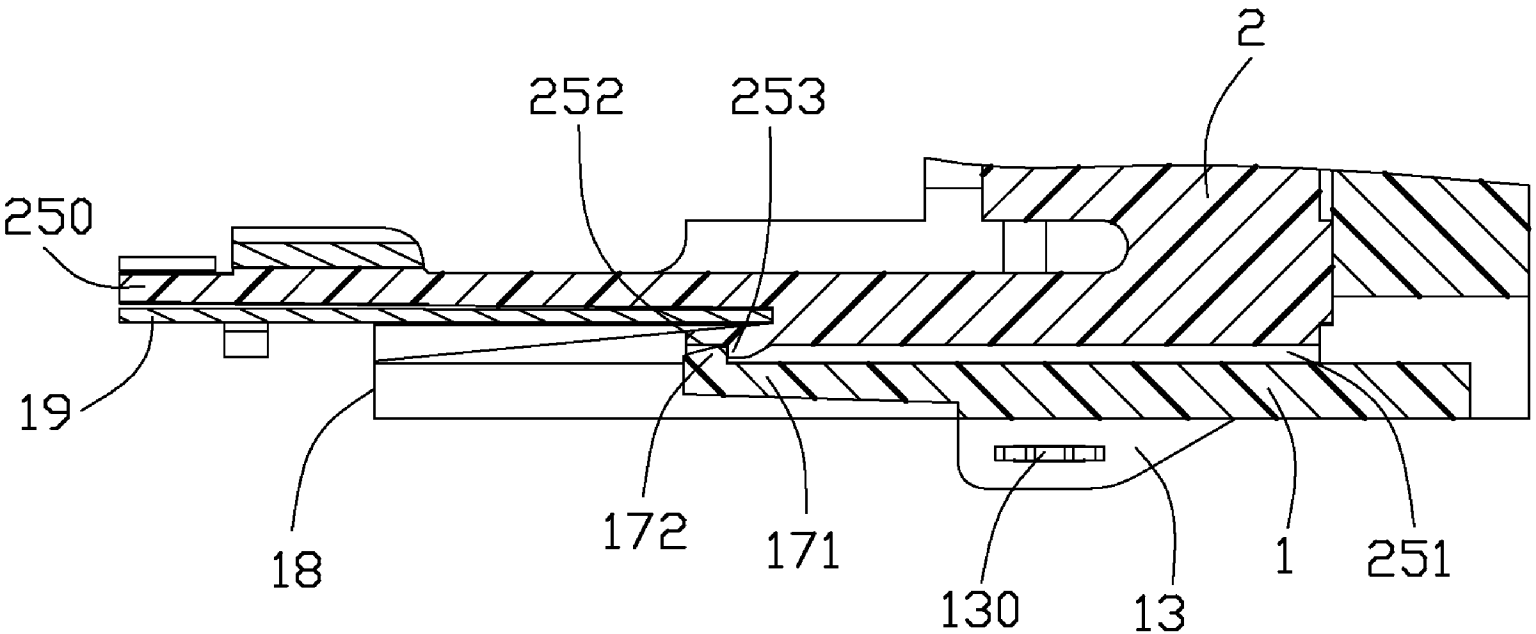
FIG. 5 is a cross-sectional view of a part of the double deck connector assembly taken along line 5-5 shown in FIG. 1.

Referring to FIGS. 2 and 4, the lower connector 2 assembled to the upper connector 1 comprises an elongate lower insulating housing 20, a number of lower terminal 21 received in the lower housing 20 and a number of fusible members 22 disposed on the corresponding lower terminals 21. The lower insulating housing 20 includes a lower main body 24 defining a lower central slot 242 for receiving a lower module (not shown) therein and a pair of lower latch devices 25 integrally extending from two opposite ends of the lower main body 24 for retaining the lower module in position. A plurality of lower passageways 241 are disposed in the lower main body 24 on opposite sides of the lower central slot 242 for receiving a corresponding number of lower terminals 21 whereby the lower terminals 21 can electrically and mechanically engage with corresponding circuit pads formed on the lower module (not shown).

Each lower latching device 25 has a lower latching arm 250 for retaining the lower module (not shown) in the lower central slot 242 of the lower connector 2. A metal supporting arm 19 is disposed beside each lower latching arm 250 and directly fastened to the lower housing 20 for provision of auxiliary strength of the lower latching arm 250 during deflection of the lower latching arm 250. The lower latching arm 250 can slide along the guiding groove 180 for guiding the lower connector 2 into the receiving space 16 of the upper connector 1. The lower latching device 25 also includes a sliding slot 251 sunk from an outside surface thereof and a buckling slot 252 sunk from a bottom surface of the sliding slot 251. A step 253 is formed at a junction of the sliding slot 251 and the buckling slot 252. The step 253 can match with the hook 172 of the upper connector 1 to assemble the upper and lower connectors 1, 2 together when the holding arm 171 sliding along the sliding slot 251. The buckling slot 252 is disposed at an end of the sliding slot 251.

When assembly, aligning the lower connector 2 with the standoff portion 15 of the upper connector 1, making the lower latching arm 250 of the lower connector 2 slide along the guiding groove 180 of the upper connector 1 and making the holding arm 171 slide along the sliding slot 251 until the hook 171 buckling the step 253. The lower connector 2 has a back surface adjacent to a front surface of the standoff portion 15 when the upper and lower connectors 1, 2 are assembled together. The lower connector 2 has a same width with the standoff portion 15.

The double deck connector assembly 100 assemble the upper and lower connectors 1, 2 together through the hook 172 of the upper connector 1 buckling the step 253 of the lower connector 2 to make the upper and lower connectors 1, 2 have same subsidence with each other when melting the fusible members 12, 22 to solder the upper and lower terminals 11, 22 to the printed circuit board (not shown), so as to prevent the upper and lower modules (not shown) respectively received in the upper and lower central slots 142, 242 from interfering and issue good electrical connection between two modules and the printed circuit board.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. A double-deck connector assembly comprising:

an upper connector having an elongate upper insulating housing defining a pair of upper latch devices aside for retaining a corresponding module therein and a plurality of upper terminals received in the upper insulating housing, the upper insulating housing defining a receiving space;

a lower connector received in the receiving space of the upper connector having a lower insulating housing defining a pair of lower latch devices aside for retaining therein a corresponding module and a plurality of lower terminals received in the lower insulating housing; and wherein each upper latch device has a holding arm integrally extending from the upper insulating housing, and each lower latch device defines a sliding slot extending therealong for matching with the holding arm to assemble the upper and lower connectors together; and wherein each sliding slot of the lower connector is sunk from an outside surface of each lower latch device and defines a buckling slot at an end thereof, and wherein a step is formed at a junction of the sliding slot and the buckling slot.

2. The double-deck connector assembly as claimed in claim 1, wherein the holding arms of the upper connector slide along the corresponding sliding slots of the lower connector when assembling and each defines a hook buckling to the step for assembling the upper and lower connectors together.

3. The double-deck connector assembly as claimed in claim 2, wherein the upper insulating housing includes an upper main body and a standoff portion extending downwardly from the upper main body, and wherein the holding arms are disposed at two opposite sides of the standoff portion.

4. The double-deck connector assembly as claimed in claim 3, wherein the upper latch devices each has a upper latching arm integrally extending from one side of the upper main body, and wherein the holding arm is located under the corresponding upper latching arm.

5. The double-deck connector assembly as claimed in claim 3, wherein the lower insulating housing of the lower connector includes a lower main body defining a lower central slot for receiving a module therein, and wherein the upper main body of the upper connector and the lower main body of the lower connector are vertically aligned with a minimum offset in a front-to-back direction.

6. The double-deck connector assembly as claimed in claim 3, wherein the upper insulating housing also has a pair of guiding arms each integrally extending from the standoff portion, and wherein the holding arm is disposed between the corresponding upper latching arm and the corresponding guiding arm, and wherein the receiving space is surrounded by the guiding arms, the main body and the standoff portion.

7. The double-deck connector assembly as claimed in claim 6, wherein the lower latch devices each includes a lower latching arm integrally extending from one side of the lower insulating housing for retaining a module in the lower insulating housing, and wherein each guiding arms defines a guiding groove under the corresponding upper latching arm for guiding the lower connector into the upper connector.

8. A double-deck connector assembly for simultaneously connecting two modules to a mother board comprising:

an unitary insulating housing defining upper and lower connection ports slightly offset from each other in a front-to-back direction thereof for respectively receiving upper and lower modules therein;

a pair of holding arms extending from two opposite ends of the upper connection port;

a pair of lower latching arms extending from two opposite ends of the lower connection port and each defining a sliding slot at an outside thereof; and wherein the holding arms extends in a same direction with the lower latching arms and can match with the sliding slots to assemble the upper and lower connection ports together;

wherein the upper connection port includes a pair of upper latching arms extending from two opposite ends thereof for retaining the upper module in position, and wherein the holding arms located under the upper latching arms each has a hook projecting inwardly from an end thereof.

9. The double-deck connector assembly as claimed in claim 8, wherein the sliding slots each defines a buckling slot sunk therefrom for receiving the hook, and wherein a pair of steps each is formed at a junction of the sliding slot and the corresponding buckling slot, and wherein the hook of the upper connection port can abut against the step to assemble the upper and lower connection ports together.

10. The double-deck connector assembly as claimed in claim 8, wherein the upper connection port also has a pair of guiding arms integrally extending from two sides thereof, wherein the holding arms each is disposed between the corresponding upper latching arm and the corresponding guiding arm.

11. The double-deck connector assembly as claimed in claim 9, wherein the guiding arms each defines a guiding groove under the corresponding arm, and wherein the lower latching arm can slide along the guiding groove to guide the lower connection port into the upper connection port.

12. The double-deck connector assembly as claimed in claim 8, wherein the holding arms of the upper connection port and the lower latching arms of the lower connection port are located at a same side of the insulating housing.

13. The double-deck connector assembly as claimed in claim 8, wherein the double-deck connector assembly also comprises a plurality of terminals received in the insulating housing and a plurality of fusible members each disposed at a bottom of the corresponding terminal.

14. A double-deck connector assembly comprising:

an upper connector defining an elongated first housing with an upper mating slot therein and a pair of stands on two opposite lengthwise ends thereof;

a space formed among the first housing and a pair of stands;

a plurality of first contacts disposed in the first housing with contacting section extending into the mating slot;

a pair of upper latch arms formed on the stands for retaining an upper module in the upper mating slot;

a lower connector positioned under the upper connector and defining an elongated second housing with a lower mating slot therein and a pair of lower latch arms formed on two opposite lengthwise ends thereof and essentially lower than the upper latch arms;

interengagement devices formed on exterior faces of said stands and on interior faces of the corresponding lower latch arms at a same level, respectively, to allow the lower connector to be not only assembled to the upper connector in a front-to-back direction, but also retained thereto in a lower portion of said space;

wherein the interengagement devices include groove structures formed in the exterior faces of the lower latch arms, and projections formed on the interior faces of the stands, respectively.

15. The double-deck connector as claimed in claim 14, wherein the groove structures terminates around a rear face of the second housing.

16. The double-deck connector as claimed in claim 15, wherein each of groove structures is equipped with a block to interlock with the projection.

17. The double-deck connector as claimed in claim 14, wherein said interengagement devices are essentially fully located in front of the first housing.

* * * * *